US006124583A

United States Patent [19]

Bowers

[11] Patent Number: 6,124,583

[45] Date of Patent: Sep. 26, 2000

[54] BARCODE READING MICROWAVE OVEN

[76] Inventor: Ford W. Bowers, 8430 Wire Rd., Zephyrhills, Fla. 33540

[21] Appl. No.: 09/294,669

[22] Filed: Apr. 19, 1999

[51] Int. Cl.[7] ..... H05B 6/68

[52] U.S. Cl. ..... 219/714; 219/702; 219/754

[58] Field of Search ..... 219/714, 702, 219/704, 706, 754, 753, 756; 99/325

[56] References Cited

U.S. PATENT DOCUMENTS

| | | | |
|---|---|---|---|
| 4,323,770 | 4/1982 | Dieulot et al. | 235/375 |
| 4,345,132 | 8/1982 | Takase et al. | 219/10.55 B |
| 4,924,048 | 5/1990 | Bunce et al. | 219/10.55 B |
| 4,968,864 | 11/1990 | Doi et al. | 219/10.55 B |
| 5,426,280 | 6/1995 | Smith | 219/506 |
| 5,504,311 | 4/1996 | DuBuis et al. | 219/714 |

FOREIGN PATENT DOCUMENTS

| | | | |
|---|---|---|---|
| 63-259327 | 10/1988 | Japan | 219/706 |
| 6-94244 | 4/1994 | Japan | 219/710 |
| WO 96/27122 | 9/1996 | WIPO | 219/714 |

*Primary Examiner*—Philip H. Leung
*Attorney, Agent, or Firm*—Joseph N. Breaux

[57] ABSTRACT

A microwave oven that automatically reads a barcode printed on a food item package, retrieves preprogrammed cooking instructions for that particular item corresponding to the barcode and then operates the microwave over, according to the manufactures specific instructions in order to achieve optimal food quality for the particular convenience food item.

1 Claim, 3 Drawing Sheets

BARCODE READING MICROWAVE OVEN

TECHNICAL FIELD

The present invention relates to cooking appliances and more particularly to a barcode reading microwave oven that includes a microwave oven assembly provided with a microwave cooking compartment having a turntable mounted therein and a barcode reader positioned on the interior sidewall thereof and aimed over the center of the turntable; the microwave oven assembly being programmed to rotate the turntable when the start button of a controller keypad connected to a microprocessor controller is activated and then read from the barcode reader until a barcode is detected, once the barcode is detected the microprocessor controller loads preset cooking instructions corresponding to the particular product codes of food items and operates the microwave oven according to those instruction.

BACKGROUND ART

Many individuals for one reason or the other find it difficult to properly operate a microwave oven to achieve the optimal food quality from convenience food items. It would be a benefit to these individuals to have a microwave oven that would automatically read a barcode printed on the food item package, retrieve preprogrammed cooking instructions for that particular item and then operate the microwave oven according to the manufactures specific instructions in order to achieve optimal food quality for that particular convenience food item.

GENERAL SUMMARY DISCUSSION OF INVENTION

It is thus an object of the invention to provide a barcode reading microwave oven that includes a microwave oven assembly provided with a microwave cooking compartment having a turntable mounted therein and a barcode reader positioned on the interior sidewall thereof and aimed over the center of the turntable; the microwave oven assembly being programmed to rotate the turntable when the start button of a controller keypad connected to a microprocessor controller is activated and then read from the barcode reader until a barcode is detected, once the barcode is detected the microprocessor controller loads preset cooking instructions corresponding to the particular product codes of food items and operates the microwave oven according to those instructions.

Accordingly, a barcode reading microwave oven is provided. The barcode reading microwave oven that includes a microwave oven assembly provided with a microwave cooking compartment having a turntable mounted therein and a barcode reader positioned on the interior sidewall thereof and aimed over the center of the turntable; the microwave oven assembly being programmed to rotate the turntable when the start button of a controller keypad connected to a microprocessor controller is activated and then read from the barcode reader until a barcode is detected, once the barcode is detected the microprocessor controller loads preset cooking instructions corresponding to the particular product codes of food items and operates the microwave oven according to those instructions.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
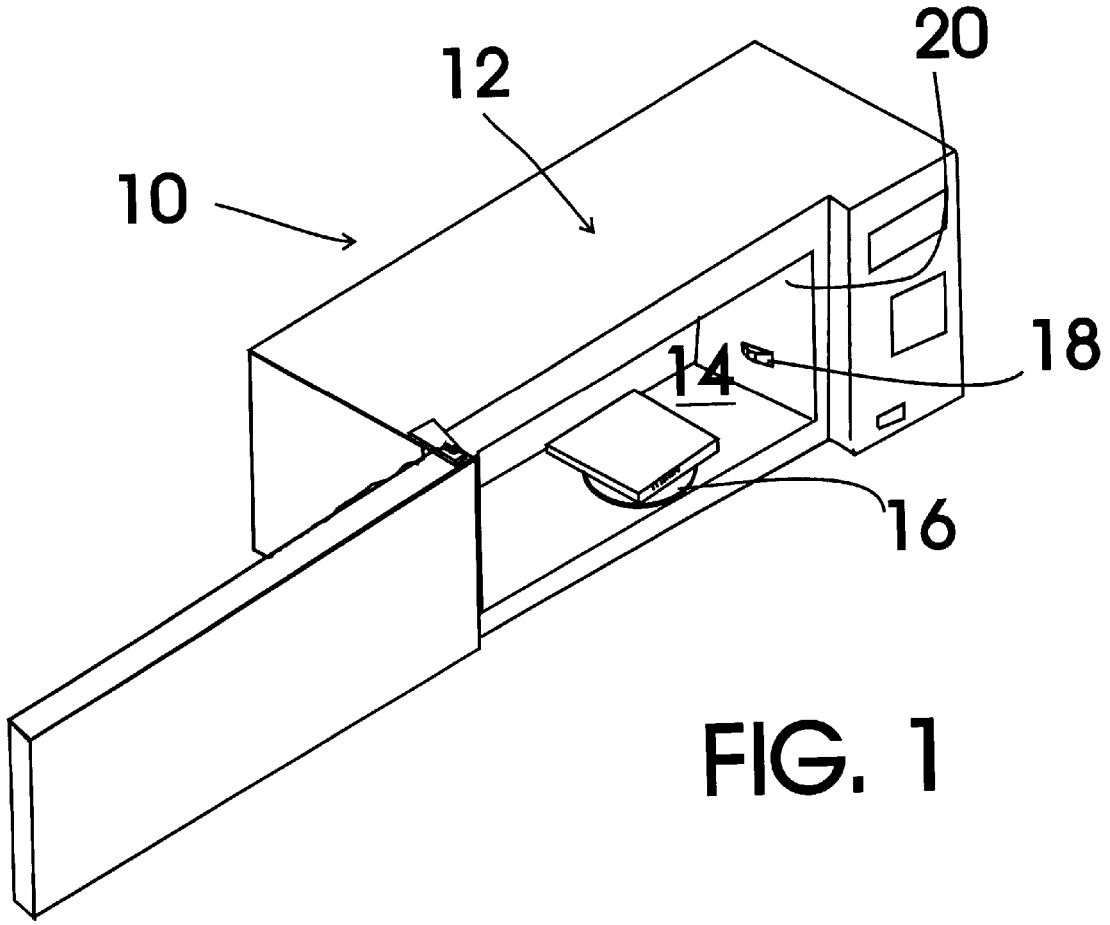
FIG. 1 is a perspective view of an exemplary embodiment of the barcode reading microwave oven of the present invention showing the microwave oven assembly including the microwave cooking compartment having a turntable mounted therein and a barcode reader positioned on the interior sidewall thereof and aimed over the center of the turntable; the microwave oven being programmed to rotate the turntable when the start button is activated and then read from the barcode reader until a barcode is detected, once the barcode is detected the microprocessor loads preset cooking instructions corresponding to the particular product codes of food items into the microwave oven controller.

FIG. 1 shows an exemplary embodiment of the barcode reading microwave oven of the present invention generally designated 10. Barcode reading microwave oven 10 includes a microwave oven assembly, generally designated 12, including a microwave cooking compartment 14 having a rotatable turntable mounted therein and a barcode reader 18 positioned on the interior sidewall 20 thereof and aimed over the center of turntable 16.

Figure 2:
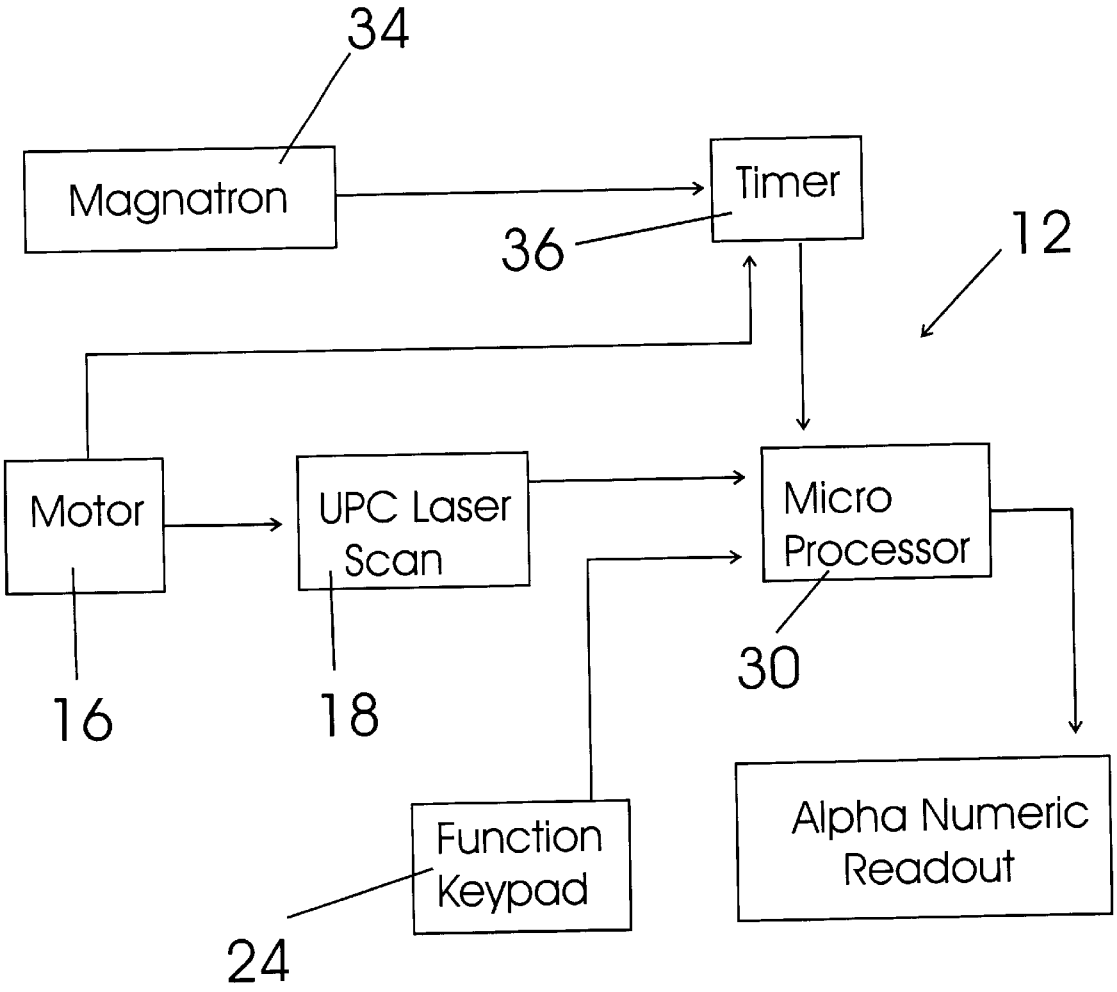
FIG. 2 is a schematic diagram showing the barcode scanner, the microwave oven turntable, the microwave emitting magnetron, the timer, the function keypad, and the microprocessor with the preprogrammed cooking instructions corresponding to particular product codes.
Figure 3:
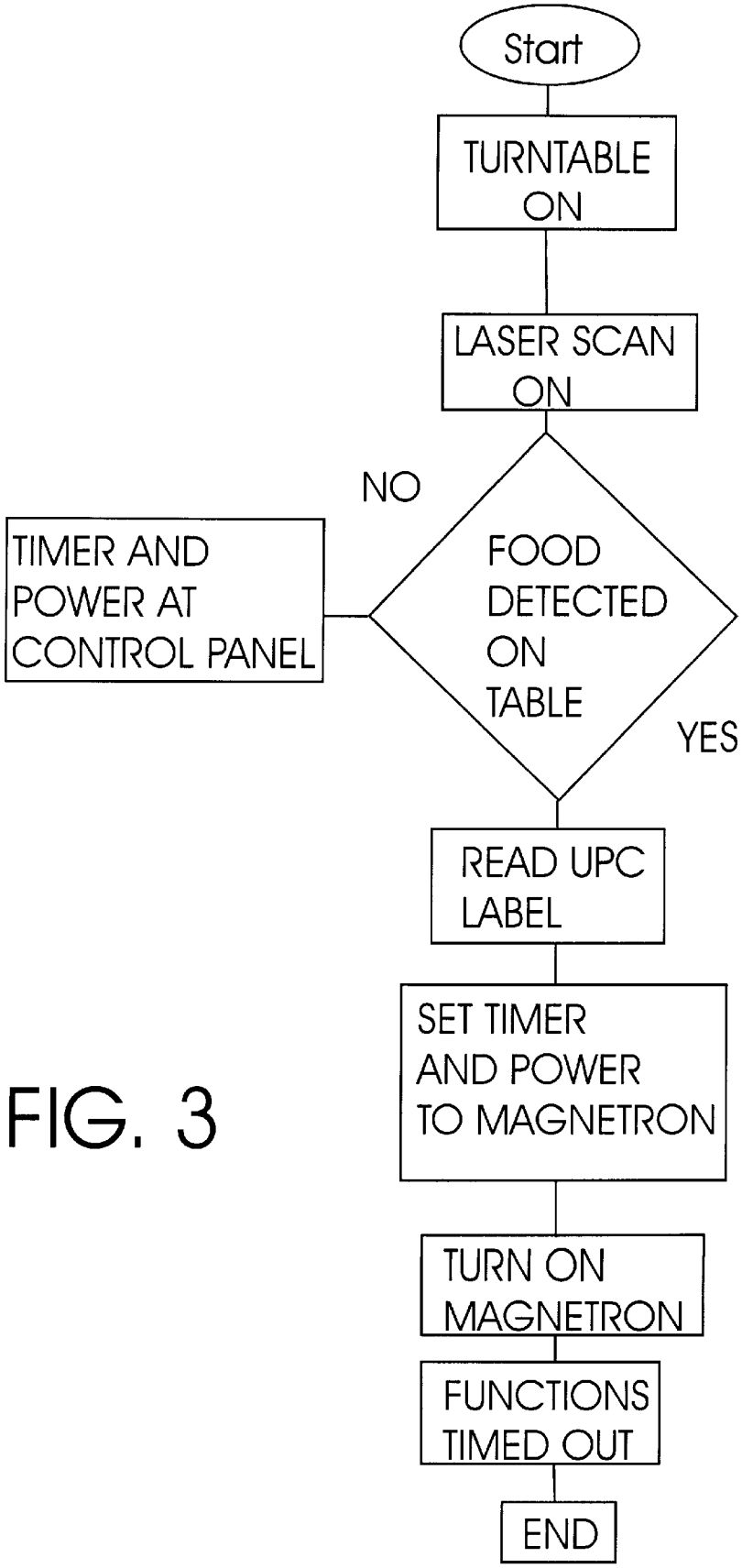
FIG. 3 is a flow chart showing the operating algorithm of the microwave oven of FIG. 1.

Referring to FIG. 2, microwave oven 12 has a microprocessor controller 30 that is programmed to rotate turntable 16 when a start button 24 is activated and then read from the barcode reader 18 until a barcode is detected. Once the barcode is detected, microprocessor controller 30 loads preset cooking instructions corresponding to the particular product codes of food items into the microwave oven controller and operates the magnetron 34 and timer 36 according to the preprogrammed instructions. FIG. 3 shows the flow chart showing operation of barcode reading microwave 10 (FIG. 1).

It can be seen from the preceding description that a barcode reading microwave oven that includes a microwave oven assembly provided with a microwave cooking compartment having a turntable mounted therein and a barcode reader positioned on the interior sidewall thereof and aimed over the center of the turntable; the microwave oven assembly being programmed to rotate the turntable when the start button of a controller keypad connected to a microprocessor controller is activated and then read from the barcode reader until a barcode is detected, once the barcode is detected the microprocessor controller loads preset cooking instructions corresponding to the particular product codes of food items and operates the microwave oven according to those instructions.

It is noted that the embodiment of the barcode reading microwave oven described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A barcode reading microwave oven comprising:

a microwave oven assembly provided with a microwave cooking compartment having a turntable mounted therein; and a barcode reader positioned on the interior sidewall thereof and aimed over the center of the turntable;

the microwave oven assembly having a microprocessor controller being programmed to rotate the turntable when the start button of a controller keypad connected to the microprocessor controller is activated and then read from tho barcode reader until a barcode is detected, once the barcode is detected tho microprocessor controller loads preset cooking instructions corresponding to the particular product codes of food items that are stored in the microprocessor memory and operates the microwave oven according to those instructions.

* * * * *